US009885375B2

(12) United States Patent
Reiss

(10) Patent No.: US 9,885,375 B2
(45) Date of Patent: Feb. 6, 2018

(54) FLOW CONDITIONER

(71) Applicant: Badger Meter, Inc., Milwaukee, WI (US)

(72) Inventor: Thomas Reiss, West Allis, WI (US)

(73) Assignee: Badger Meter, Inc., Milwaukee, WI (US)

( * ) Notice: Subject to any disclaimer, the term of this patent is extended or adjusted under 35 U.S.C. 154(b) by 2 days.

(21) Appl. No.: 15/046,880

(22) Filed: Feb. 18, 2016

(65) Prior Publication Data

US 2016/0238046 A1 Aug. 18, 2016

Related U.S. Application Data

(60) Provisional application No. 62/117,789, filed on Feb. 18, 2015.

(51) Int. Cl.
*F15D 1/02* (2006.01)

(52) U.S. Cl.
CPC ..... *F15D 1/025* (2013.01)

(58) Field of Classification Search
USPC ..... 138/39, 42
See application file for complete search history.

(56) References Cited

U.S. PATENT DOCUMENTS 1,418,877 A * 6/1922 Mabee ..... F02M 1/00 138/42
3,109,459 A * 11/1963 Lee, II ..... F15B 21/00 138/40
3,990,858 A * 11/1976 O'Sullivan ..... F15D 1/02 138/40
4,024,891 A * 5/1977 Engel ..... F16K 47/04 137/625.3
4,043,539 A * 8/1977 Gilmer ..... B01F 5/0659 138/42
4,324,571 A * 4/1982 Johnson, Jr. ..... B01D 46/0041 138/177
4,408,892 A * 10/1983 Combes ..... B01F 5/0689 138/42
4,415,369 A * 11/1983 Allmendinger ..... F28G 9/00 134/117
4,418,722 A * 12/1983 Kendall ..... B01J 3/02 138/42
4,994,242 A * 2/1991 Rae ..... B01F 5/0256 138/37
5,099,879 A * 3/1992 Baird ..... F15D 1/02 137/561 A
5,588,635 A * 12/1996 Hartman ..... F15D 1/04 138/44
5,762,107 A 6/1998 Laws
5,772,178 A * 6/1998 Bey ..... F16K 47/08 138/42

(Continued)

*Primary Examiner* — James Hook
(74) *Attorney, Agent, or Firm* — Boyle Fredrickson; Keith M. Baxter; Michael S. Brayer

(57) ABSTRACT

A flow conditioning device for insertion in a flow conduit transporting a flow stream includes a top flange defining a flow conditioning opening having an opening area size and receiving the flow stream, a bottom base receiving the flow stream after the flow stream passes through the top flange having a base area size, and a conditioning wall joining the top flange to the bottom base, where the opening area size is greater than the base area size.

16 Claims, 2 Drawing Sheets

(56) References Cited

U.S. PATENT DOCUMENTS

| | | | | |
|---|---|---|---|---|
| 6,000,433 | A * | 12/1999 | Carroll | B01D 46/10 138/41 |
| 6,701,963 | B1 * | 3/2004 | Hill | G01F 15/00 138/116 |
| 2010/0224275 | A1 * | 9/2010 | Pinkerton | G01F 15/00 138/39 |

* cited by examiner

FLOW CONDITIONER

CROSS-REFERENCE TO RELATED APPLICATIONS

This application claims the benefit of U.S. Provisional Application No. 62/117,789 filed Feb. 18, 2015 hereby incorporated by reference.

FIELD OF THE INVENTION

This application relates to a flow conditioner used to increase the symmetry of a flow profile inside a pipe to improve the accuracy of any meter that infers an average velocity from a single location.

BACKGROUND

Flow conditioners are typically used to reduce swirl and increase the symmetry of a flow profile inside a pipe to improve the accuracy of any meter that infers an average velocity from a single location. Flow conditioners are used typically in round pipes with a variety of flow meters such and a silt density index (SDI) meter, an ultrasonic meter, etc.

However, typical flow conditioners typically have suboptimal performance under certain conditioners. One such condition occurs when a flow is directed around a pipe elbow. The elbow introduces swirl into the flow that reduces the consistency of the flow across a cross-section of the pipe for a length of the pipe. An elbow further increases the velocity of the flow at the outside of the elbow while simultaneously decreasing the velocity at the inside of the elbow. Flow conditioners typically require a length of straight pipe to have a uniform flow prior to flow being conditioned by a flow conditioner.

Accordingly, there remains a need for a flow conditioner that is configured to condition a flow having an asymmetric flow profile. There further remains a need for such a flow conditioner conditioning the flow by distributing the asymmetry to have an asymmetry that is uniform across the diameter of the flow profile.

Other features of the flow conditioner, besides those discussed above, will be apparent to those of ordinary skill in the art from the description of the preferred embodiments which follows. In the description, reference is made to the accompanying drawings, which form a part hereof, and which illustrate examples of the invention. Such examples are illustrative, but for the scope of the invention, reference is made to the claims which follow the description.

DETAILED DESCRIPTION OF THE INVENTION

Figure 1A:
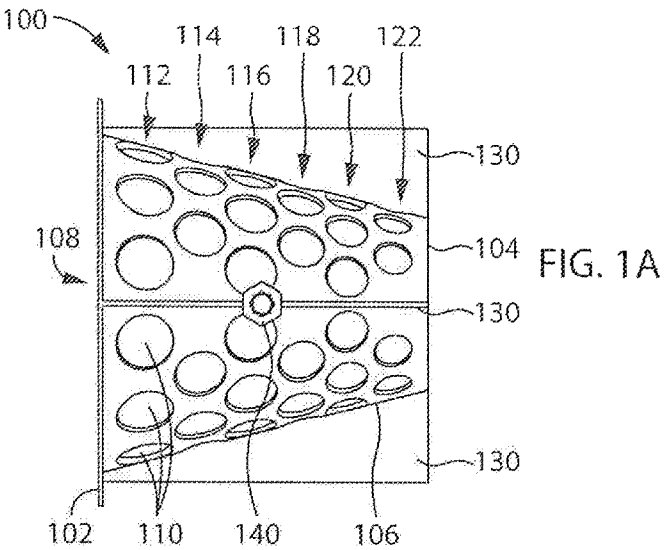
FIG. 1A is a cross section view of a conical flow conditioner, according to an exemplary embodiment.
Figure 1B:
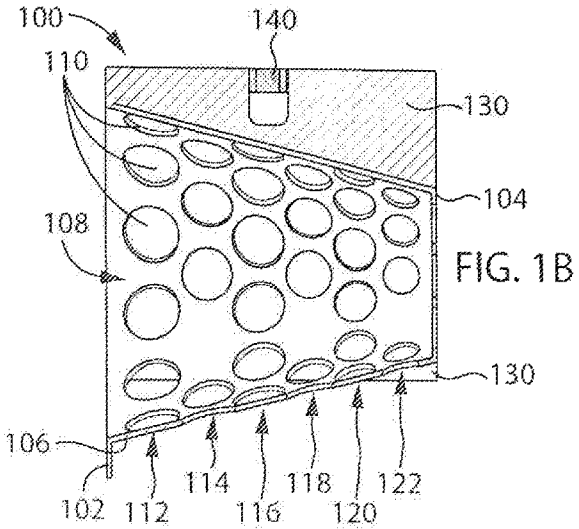
FIG. 1B is a cross section view of a conical flow conditioner of FIG. 1A, rotated 90 degrees, according to an exemplary embodiment.
Figure 1C:
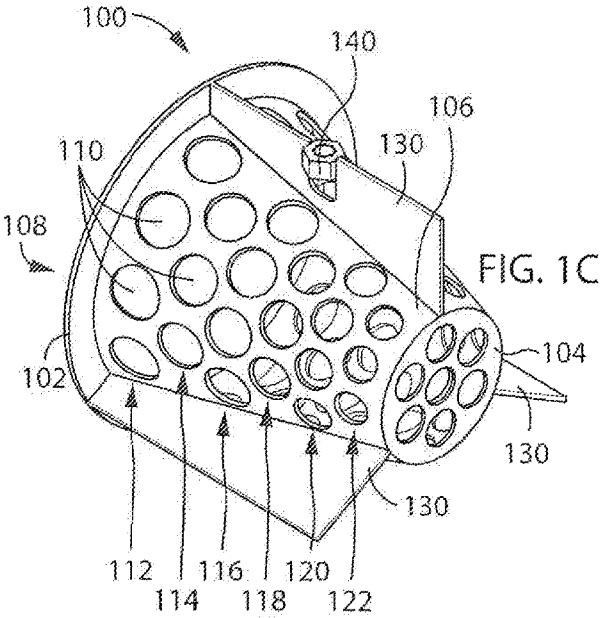
FIG. 1C is a perspective view of a conical flow conditioner of FIG. 1A.

Referring to FIG. 1A, a cross section view of a conical flow conditioner 100 is shown, according to an exemplary embodiment. The conical flow conditioner 100 is configured to provide a reduced flow diameter using a conical formation to introduce a uniform swirl to the flow profile to facilitate flow measurement. This conical formation increases the amount of swirl in the flow profile to mix the pattern of flow velocity and distribute the flow including the asymmetries uniformly across the flow profile. The conical flow conditioner 100 is shown rotated 90 degrees from the view in FIG. 1B, according to the same exemplary embodiment. FIG. 1C is a perspective view of the exemplary embodiment.

Figure 1D:
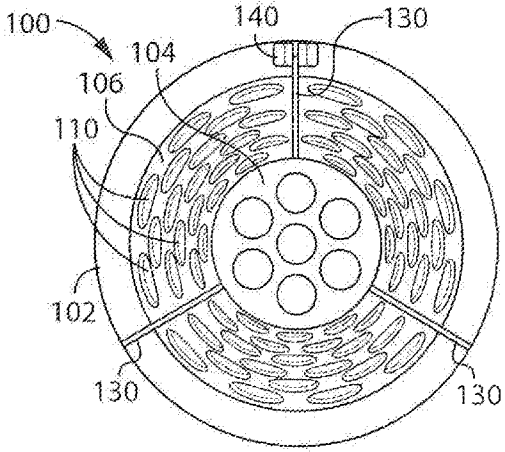
FIG. 1D is an end view of a conical flow conditioner of FIG. 1A.

Referring to FIGS. 1A-1D, flow conditioner 100 features a conical configuration having a top flange 102 and a base 104 with a cone wall 106 extending from the top flange 102 to the base 104. The diameter of the cone wall 106 decreases from the point at which the cone wall 106 adjoins the top flange 102 to the point at which the cone wall 106 adjoins the base 104. The cone wall 106 further defines a pre-conditioner flow space 108. The conical shape of the pre-conditioner flow space 108 funned by the reducing diameter of the cone wall 106 introduces additional asymmetries to the flow entering the pre-conditioner flow space 108 based on interaction of the fluid with the cone wall 106. FIG. 1D is an end view of the exemplary embodiment locking from the base 104 towards the top flange 102.

The cone wall 106 includes a plurality of cone wall apertures 110 that al low fluid to flow from the pre-conditioner flow space 108 thru the conical flow conditioner 100. The cone wall 106 is angled such that the reduction in cross section increases pressure drop to promote flow to exit more evenly through the cone wall apertures 110, rather than being biased towards the base 104.

Cone wall apertures 110 are configured to decrease in diameter along the length of the cone wall 106. Accordingly, cone wall aperture 110 include a first row 112 of apertures having a diameter of 1.38 inches, a second row 114 of apertures having a diameter of 1.25 inches, a third row 116 of apertures having a diameter of 1.25 inches, a fourth row 118 of apertures having a diameter of 1.13 inches, a fifth row 120 of apertures having a diameter of 1.00 inches, and a sixth row 122 of apertures having a diameter of 0.88 inches. The apertures 110 have a reducing diameter to maintain aperture 110 spacing its the circumference of the cone wall 106 is reduced along the length of the cone wall 106. Further, the reducing diameter of apertures 110 may be based on the reduced flow velocity of a fluid as the fluid travels though the pre-conditioner flow space 108 from the top flange 102 to the base 104. Although a specific configuration and diameter of aperture 110 is shown and described, one of ordinary skill in the art would easily understand that the configuration and diameters of apertures 110 may vary considerably dependent on the size of the pipe, the type of fluid, etc. and still achieve the advantages described herein.

Flow conditioner 100 further includes a plurality of straightening vanes 130 to remove the swirl introduce by interaction of the fluid with the cone wall 106 in the pre-conditioner flow space 108. One of the vanes 130 is configured to include a locking nut 140 configured to facilitate mounting of the flow conditioner 100 to a pipe wall (not shown).

Figure 2A:
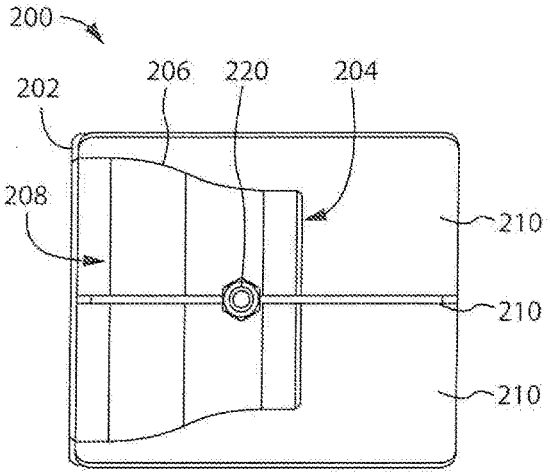
FIG. 2A is a cross section view of a conical flow conditioner, according to an alternative embodiment.

Referring to FIG. 2A, a cross section view of a conical flow conditioner 200 is shown, according to an exemplary embodiment. The conical flow conditioner 200 is shown rotated 90 degrees from the view in FIG. 2B, according to the same exemplary embodiment. Flow conditioner 200 similarly is configured to have a conical formation that increases the amount of swirl in the flow profile to mix the pattern of flow velocity and distribute the flow including the asymmetries uniformly across the flow profile.

Figure 2B:
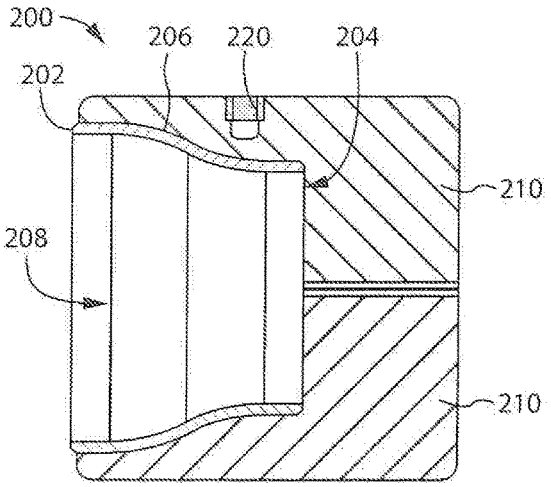
FIG. 2B is a cross section view of a conical flow conditioner of FIG. 2A, rotated 90 degrees, according to an exemplary embodiment.
Figure 2C:
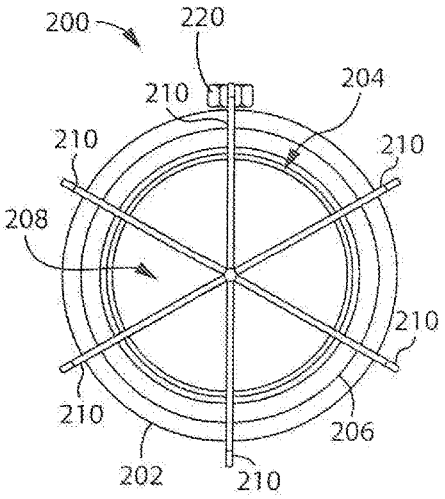
FIG. 2C is an end view of a conical flow conditioner of FIG. 2A.

Referring to FIGS. 2A-2C, flow conditioner 200 similarly features a conical configuration having a top flange 202 and a flow aperture 204 with a cone wall 206 extending from the top flange 202 to the flow aperture 204. The diameter of the cone wall 206 similarly decreases from the point at which the cone wall 206 adjoins the lop flange 102 to the point at which the cone wall 206 defines the flow aperture 204. The cone wall 206 further defines a pre-conditioner flow space 208. The conical shape of the pre-conditioner flow space 208 formed by the reducing diameter of the cone wall 206 also introduces additional asymmetries to the flow entering the pre-conditioner flow space 208 based on interaction of the fluid with the cone wall 206. FIG. 2C is an end view of the exemplary embodiment locking from the flow aperture 204 towards the top flange 202.

Cone wall 206 is configured to be shape to include a defined radial curve to reduce the occurrence of vena contracta at the flow aperture 204. Vena contracta is the point in a fluid stream where the diameter of the fluid flow is the least, and fluid velocity is at its maximum. The maximum contraction of the fluid flow would typically take place at a section slightly downstream of the flow aperture 204 if the cone wall 206 were straight. However, introducing the defined radial curve to the cone wall 206 reduces the occurrence of vena contracta at the flow aperture 204 such that the maximum contraction of the fluid flow takes place more proximate to the flow aperture 204.

Flow conditioner 200 further includes a plurality of straightening vanes 210 to remove the swirl introduce by interaction of the fluid with the cone wall 206 in the pre-conditioner flow space 208. One of the vanes 210 is configured to include a locking nut 220 configured to facilitate mounting of the flow conditioner 200 to a pipe wall.

Flow conditioners as described herein in the above described embodiments reduce the straight pipe length that is required to achieve accurate measurement. Further, the flow conditioners described herein provide this advantage by reducing the amount of restriction to the flow to avoid significantly reducing flow velocity and introducing a pressure drop. This reduction saves materials, space and cost.

This has been a description of exemplary embodiments, but it will be apparent to those of ordinary skill in the art dial variations may be made in the details of these specific embodiments without departing from the scope and spirit of the present invention, and that such variations are intended to be encompassed by this description.

What is claimed is:

1. A flow conditioning device for insertion in a flow conduit transporting a flow stream, comprising:

a top flange defining a flow conditioning opening having an opening area size and receiving the flow stream;

a bottom base plate receiving the flow stream after the flow stream passes through the top flange, the bottom base plate having a base area size occupying a base plane that is essentially parallel to a top flange plane occupied by the top flange; and a conditioning wall including a plurality of rows of conditioning wall apertures, the conditioning wall joining the top flange to the bottom base plate, wherein the plurality of rows includes at least a first row being adjacent to the top flange and a last row being adjacent to the bottom base plate, further wherein a size of a conditioning aperture decreases in each row between the first row and the last row, wherein the opening area size is greater than the base area size.

2. The flow conditioning device of claim 1, wherein the top flange and the bottom base plate are circular such that the top flange, bottom base plate and conditioning wall form a conical cup that receives the flow stream.

3. The flow conditioning device of claim 2, further including a plurality of straightening vanes affixed to the outside of the conical cup and extending parallel to the direction of the flow stream.

4. The flow conditioning device of claim 1, wherein the conditioning wall forms defines a circular cross section at each point on the circular wall between the top flange and the bottom base plate, the circular cross section at each point having a diameter that decreases along the length of the conditioning wall extending from the top flange to the bottom base plate.

5. The flow conditioning device of claim 4, wherein the conditioning wall is formed in a radial curve along the length of the conditioning wall such that decrease in diameter is non-linear.

6. The flow conditioning device of claim 1, wherein the different sizes of the plurality of conditioning wall apertures interacts cooperatively with the conditioning wall to allow the flow stream to pass, at least in part, through the conditioning wall more evenly.

7. The flow conditioning device of claim 1, wherein the conditioning wall forms a conical cup having a diameter that decreases along the length of the conditioning wall extending from the top flange to the bottom base plate and the reduction in the size of the conditioning wall apertures correlates to the decreasing diameter.

8. The flow conditioning device of claim 1, wherein the bottom base plate includes one or more base openings allowing the flow stream to pass, at least in part, through the bottom base plate.

9. A flow conditioning device for insertion in a flow conduit transporting a flow stream, comprising:

a top flange defining a flow conditioning opening having an opening area size and receiving the flow stream;

a bottom base plate receiving the flow stream after the flow stream passes through the top flange, the bottom base plate having a base area size occupying a base plane that is essentially parallel to a top flange plane occupied by the top flange; and a conditioning wall including a plurality of rows of conditioning wall apertures of at least two different sizes, the conditioning wall configured to produce a uniform swirl in the flow stream, wherein the plurality of rows includes at least a first row being adjacent to the top flange and a last row being adjacent to the bottom base plate, further wherein a size of a conditioning aperture decreases in each row between the first row and the last row.

10. The flow conditioning device of claim 9, wherein producing a uniform swirl includes disrupting an asymmetric flow existing in the flow stream prior to being received through the top flange.

11. The flow conditioning device of claim 9, wherein the conditioning wall forms a circular cup having a diameter that decreases along the length of the conditioning wall extending from the top flange to the bottom base plate.

12. The flow conditioning device of claim 11, wherein the conditioning wall is formed in a radial curve along the length of the conditioning wall such that decrease in diameter is non-linear.

13. The flow conditioning device of claim 9, wherein the different sizes of the plurality of conditioning wall apertures interacts cooperatively with the conditioning wall to allow the flow stream to pass, at least in part, through the conditioning wall more evenly.

14. The flow conditioning device of claim 9, wherein the conditioning wall forms a conical cup having a diameter that decreases along the length of the conditioning wall extending from the top flange to the bottom base plate and the reduction in the size of the conditioning wall apertures correlates to the decreasing diameter.

15. The flow conditioning device of claim 14, further including a plurality of straightening vanes affixed to the outside of the conical cup and extending parallel to the direction of the flow stream.

16. The flow conditioning device of claim 9, wherein the bottom base plate includes one or more base openings allowing the flow stream to pass, at least in part, through the bottom base plate.

* * * * *